United States Patent [19]

Jentoft et al.

[11] 4,189,877

[45] Feb. 26, 1980

[54] EXPANSION JOINT COVER

[75] Inventors: Arthur P. Jentoft; Joseph P. Anghinetti, both of Kennebunkport; Paul A. Couture, Emery Mills, all of Me.

[73] Assignee: York Manufacturing, Inc., Sanford, Me.

[21] Appl. No.: 956,083

[22] Filed: Oct. 30, 1978

Related U.S. Application Data

[63] Continuation of Ser. No. 708,877, Jul. 26, 1976, abandoned, which is a continuation of Ser. No. 584,051, Jun. 5, 1975, abandoned.

[51] Int. Cl.[2] ..... E04B 1/68

[52] U.S. Cl. ..... 52/58; 52/472; 52/573; 52/469; 52/98

[58] Field of Search ..... 52/573, 716, 419, 420, 52/417, 469, 58, 98–100, 105, 631, 255

[56] References Cited

U.S. PATENT DOCUMENTS

| | | | |
|---|---|---|---|
| 449,636 | 3/1891 | Smith | 52/105 |
| 2,313,990 | 3/1943 | Crandell | 52/417 |
| 2,669,116 | 2/1954 | Erickson | 52/99 |
| 2,850,196 | 9/1958 | Feltz | 52/573 |
| 2,974,078 | 3/1961 | Petritz | 52/417 |
| 3,300,913 | 1/1967 | Patry | 52/573 |
| 3,399,448 | 9/1968 | Jackson | 52/716 |
| 3,470,662 | 10/1969 | Kellman | 52/573 |
| 3,581,450 | 6/1971 | Patry | 52/573 |
| 3,694,976 | 10/1972 | Warshaw | 52/573 |
| 3,755,031 | 8/1973 | Hoffman | 52/631 |

*Primary Examiner*—Stephen J. Novosad
*Assistant Examiner*—Henry E. Raduazo
*Attorney, Agent, or Firm*—Wolf, Greenfield & Sacks

[57] ABSTRACT

A covering for an expansion joint of a building is formed from an extruded thin vinyl strip having a relatively thick expanded plastic insulating strip secured to one side of the vinyl strip. A reinforcing strip of material may be bonded securely to the vinyl between the vinyl and foam insulating strip in a sandwiched configuration to provide dimensional stability for the assembly and particularly to resist shrinkage of the assembly in a longitudinal direction. The vinyl strip is wider than the foam insulating strip to define longitudinal marginal flanges extending along the length of the strip. Metal nailing strips are embedded in the longitudinal flanges to facilitate attachment of the flanges to the spaced building sections which define the expansion joint. The nailing strips are formed to define a weakened, longitudinally extending line to facilitate longitudinal bending of the flanges along the nailing strips directly at the construction site without the use of heavy bending equipment.

6 Claims, 6 Drawing Figures

EXPANSION JOINT COVER

This is a continuation of application Ser. No. 708,877, filed July 26, 1976 (now abandoned) which in turn is a continuation of Ser. No. 584,051, filed June 5, 1975 (now abandoned).

BACKGROUND OF THE INVENTION

This invention relates to expansion joint covers of the type generally employed in buildings to cover adjacent, spaced sections of an expansion joint. A typical expansion joint cover may include an elongate plastic strip and a thicker insulative strip secured to one surface of the plastic strip and extending along its length. The plastic strip is wider than the insulative strip to define flanges which extend longitudinally of the strip and outwardly to each side of the insulative strip. The flanges are employed to attach the device to the spaced building sections which define the expansion joint. In general, these strips are placed over the joint with the insulative material facing inwardly and the flanges are secured to the spaced building sections. Typically, the midportion of the cover, to which the insulative strip is secured, is arched outwardly so that the region between the flanges, including the insulative strip, is generally U-shaped.

It is desirable to fabricate the cover by an extrusion technique in which the plastic strip is extruded and the insulative material is then applied. The composite strip then is wound up on a roll which is a convenient form for storage and shipping.

In order to facilitate attachment of the longitudinal flanges to the spaced building portions which define the expansion joint, metal nailing strips often are secured to the flanges, the nailing strips being provided with a plurality of regularly spaced holes through which nails may be driven. The nailing strips, however, do present some difficulties, particularly in those instances where the flanges must be bent longitudinally to facilitate their attachment to a curb. Typically the bend in the flange is made longitudinally and along the nailing strip. The bending of the flange at this region requires relatively heavy bending equipment which is generally unsuitable for use at the construction site. Because of this, expansion joint covers which are intended to be used with curbs must be pre-bent at the factory. However, once the flanges have been bent, the cover cannot be wound into a convenient rolled-up package. Typically, the pre-bent cover is cut into short, straight sections (for example, ten foot lengths) and shipped in that configuration. In addition to the disadvantage of shipping and handling a plurality of straight sections, the use of the shorter pre-bent sections necessarily results in a large number of splices in the finally installed expansion joint cover because it must be made from a greater number of individual spliced short, straight sections. This, of course, increases the chances of a splice separating, because of the larger number of splices, and also results in a higher installation cost because of the increased labor required to place a plurality of separate, shorter lengths as distinguished from a single, much longer length of cover.

It is among the general objects of the invention to provide an improved expansion joint cover which avoids the above and other difficulties.

SUMMARY OF THE INVENTION

In accordance with the present invention a vinyl strip is extruded in a continuous length and has a pair of metal nailing strips embedded in the flange portions during the extrusion process. As the vinyl strip exits from the extrusion die, a reinforcing material, for example, fiberglass in strand or woven form, may be bonded to the middle region of one side of the vinyl as described and claimed in an application of even date herewith of Arthur P. Jentoft entitled Expansion Joint Cover, and assigned to the assignee of this application. Resilient foam insulative material then is bonded to the vinyl on top of the fiberglass reinforcement in a three layer, sandwich configuration. The metal nailing strip is dimensioned so that it occupies nearly the full width of each of the flanges. The strip has a multiplicity of nail holes formed therethrough which are filled with the vinyl material during the extrusion process. In addition, each of the nailing strips also has a weakened longitudinal bend line which is designed to enable the flanges to be bent, along that weakened line, by hand and at the construction site.

The cover thus may be extruded and wound up on a roll. The weakened bend line permits on-site bending without requiring special heavy bending machinery. As a result, expansion joint cover strips may be delivered to the site in fifty or one hundred foot rolls and can be used in an unbent or bent configuration as desired. In either event a minimum number of splices is required.

It is among the primary object of the invention to provide an improved expansion joint cover.

Another object of the invention is to provide an expansion joint cover which is capable of being rolled up even when it is to be installed by attachment to a curb.

A further object of the invention is to provide an expansion joint cover which is capable of being bent along its metal nailing strip in the field without requiring heavy bending equipment.

Still another object of the invention is to provide an expansion joint cover in which the likelihood of splices opening is reduced substantially.

DESCRIPTION OF THE DRAWINGS

The foregoing and other objects and advantages of the invention will be understood more fully from the following further description thereof, with reference to the accompanying drawings in which.

DESCRIPTION OF THE PREFERRED EMBODIMENT

Figure 1:
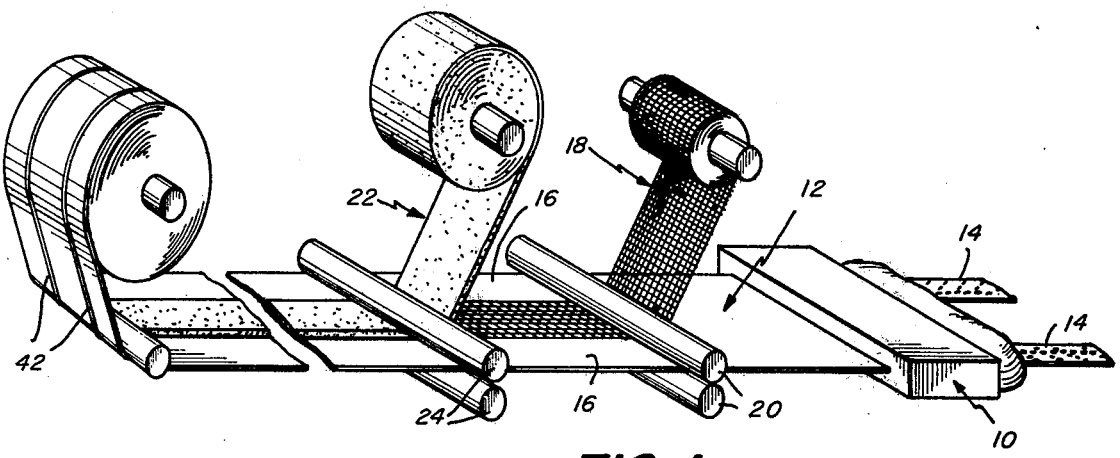
FIG. 1 is a somewhat diagrammatic illustration of the manner in which the expansion joint cover may be fabricated.
Figure 2:
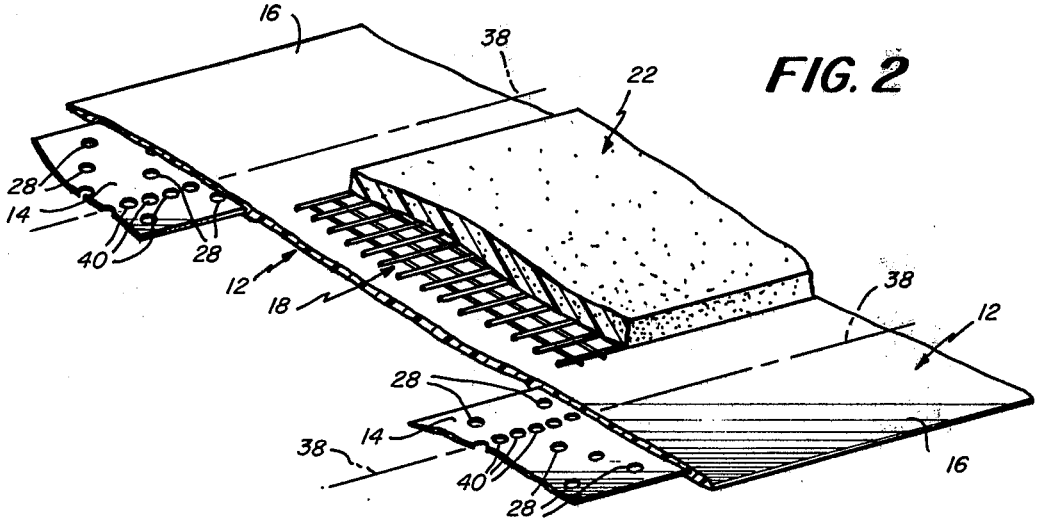
FIG. 2 is a partly sectional and partly broken away illustration of a segment of the expansion joint cover made in accordance with the invention.

FIG. 1 shows, diagrammatically, the manner in which the expansion joint cover of the invention may be fabricated. In the illustrated embodiment, the cover may be made in part from a thermoplastic, extrudable material such as vinyl which is extruded in a continuous length from an extrusion die 10 having an outlet which forms a flat continuous ribbon or strip 12. By way of example, a typical extruded strip 12 may be of the order of 14" wide and of the order of 0.050" thick at its middle region. As mentioned above, in the preferred embodiment of the invention, the cover includes a pair of nailing strips 14 which are embedded in the marginal, flange-defining portions 16 of the strip. The nailing strips 14 are incorporated by introducing them through slots at the backside of the extrusion die 10 and which exit from the outlet of the die 10 together with and embedded in the vinyl strip 12.

After the vinyl strip 12 and embedded nailing strips 14 have exited from the extrusion die 10, a web of reinforcing material, indicated generally at 18, is deposited on one surface of the vinyl strip 12 and is bonded thereto at nip rollers 20, as described more fully in said application of Arthur P. Jentoft.

As illustrated in FIG. 1 a strip of flexible, resilient and insulative material 22, such as an appropriate foam plastic or rubber, is layed down on top of the reinforcing web 18 and the assembly is passed through another pair of nip rollers 24 to firmly bond the insulative strip 22 and sandwich the three elements firmly together. The bonding between the insulative material 22 and the reinforced strip 12 may be effected by applying the insulative strip 22 while the upper surface of the vinyl strip 12 still is warm or, depending on the nature of the particular materials employed, a supplemental and compatible adhesive agent may be employed.

Figure 3:
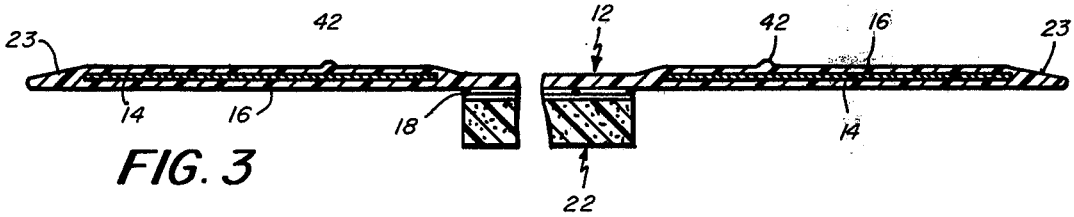
FIG. 3 is a transverse, sectional illustration of the expansion joint cover.
Figure 4:
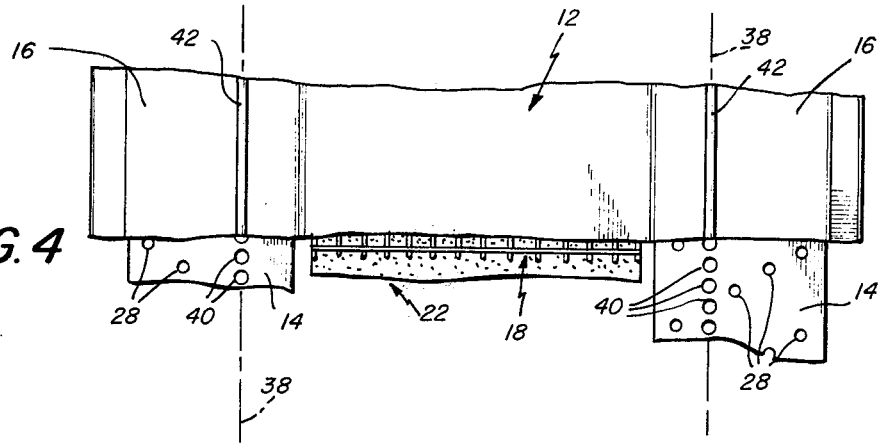
FIG. 4 is a partly broken away illustration of a segment of the expansion joint cover as seen from the externally facing side.

The insulative strip 22 typically is thicker than the strip 12 and, for example, may be of the order of ½" thick. The width of the reinforcing web 18 and the insulative strip 22 is less than the overall width of the strip 12 so the resulting sandwich defines the longitudinal flanges 16 extending outwardly from each side of the insulative strip and along the lateral margins of the assembly. By way of example, in the embodiment illustrated, the flange portions of the strip 12 may be of the order of 6" in width. The relative dimension of the nailing strips 14 and the flanges 16 in which they are embedded is such that the nailing strips 14 occupy a substantial portion of the width of each margin. In the embodiment illustrated, the flanges may be approximately 3¼" wide. The outermost edges of the flanges may extend about ½" from the nailing strip and may be beveled as shown at 23. By way of further example, the nailing strips may be made from galvanized steel and may be of the order of 0.015" thick. The thickness of the strip 12 in the flange regions 16 which contain the nailing strips 14 may be, overall, slightly more than twice the thickness of the more central region of the strip 12. Thus, in the arrangement in which the central region of the strip 12 is of the order of 0.05" thickness, the overall thickness of the flange regions may be slightly more than 0.100" thick, as may be seen from FIG. 3. The continuous lengths of joint cover thus made are wound up on rolls, for example in fifty or one hundred foot lengths.

Figure 5:
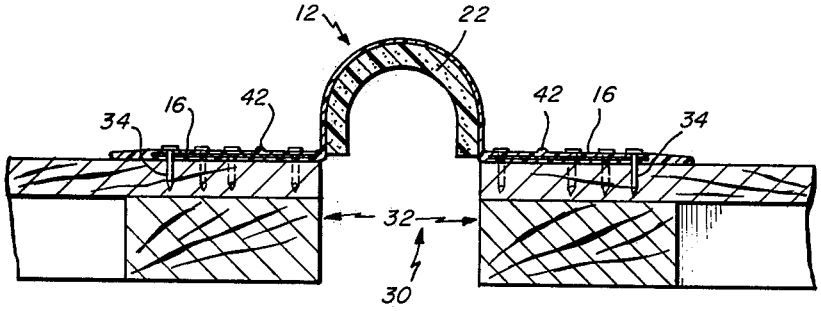
FIG. 5 is a sectional elevation illustrating one type of installation of the cover.

The embedded nailing strips include a multiplicity of regularly spaced nailing holes 28 by which the flanges 16 may be secured to the spaced portions of the building which define the expansion joint. FIG. 5 illustrates a typical installation in which the cover is placed over the space 30 between adjacent building sections 32 with the insulative portion 22 spanning the space 30 and being bent in an arched, U-shaped configuration. Typically, the expansion joint cover will be placed so that the vinyl strip 12 faces outside and the insulative strip 22 faces inwardly. The flanges 16 are placed over the adjacent edges of the building sections 32 and are securely nailed thereto by nails 34 driven through the nail holes 28 in the nailing strips 14.

Figure 6:
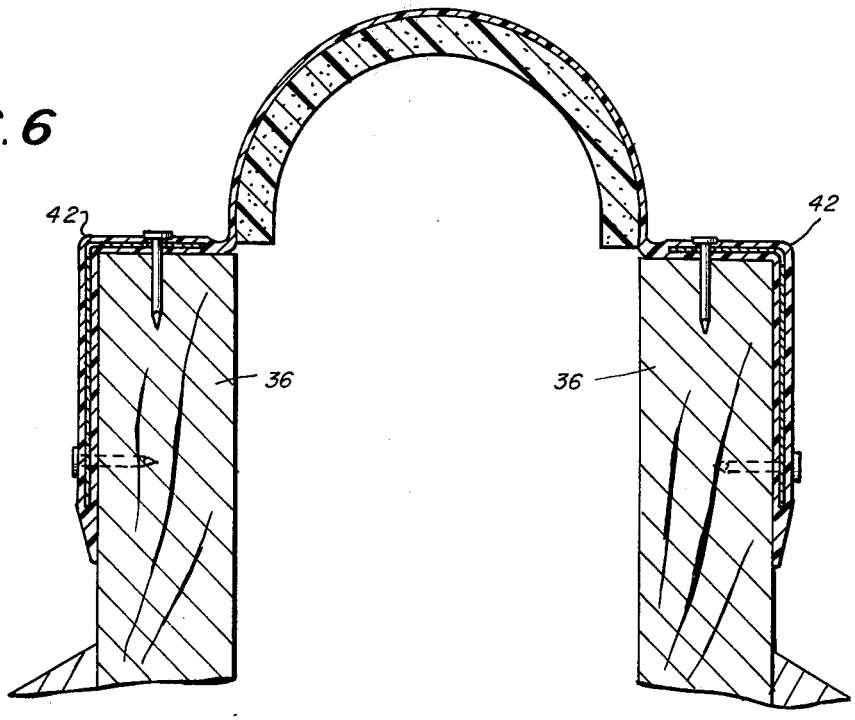
FIG. 6 is a sectional elevation illustrating an alternative installation of the cover.

As mentioned above, also among the features of the invention is that the nailing strip 14 is constructed to facilitate in-field, on-site longitudinal bending when it is desired to attach one or both of the flanges to a curb. This is illustrated in FIG. 6 in which both of the building sections which define the space 30 to be covered have a built-up curb 36. Here it is desirable to employ flanges 16 which are bent along their lengths so that they may be fitted over the curbs 36 as shown. In order to facilitate on-site bending of the flanges 16 and along the nailing strips 14, each of the nailing strips 14 are formed with a weakened longitudinal line, as suggested by the line 38. In the embodiment illustrated, the weakened line 38 may be defined by a plurality of regularly spaced holes 40 formed along a longitudinal line of the flanges 24 in which the nailing strips 14 are embedded. The holes 40 are dimensioned and spaced so that the flanges 16 can be bent, longitudinally, along the nailing strips 14 in a manual operation without requiring the use of heavy metal bending equipment which is unsuitable for use at the construction site. It should be noted, however, that while the weakened bend line 38 is desirably formed in this manner, other means may be employed to effect the weakened line, such as by scoring the nailing strips 14 longitudinally to define the weakened bend line. The location of the longitudinal bend line 38 widthwise in the flange may be varied depending on the particular type of installation in which the expansion joint cover is to be employed. As shown in the illustrative embodiment, the bend line 38 preferably is disposed more closely to the insulative portion than to the outer extremity of the flange. For example, in the embodiment described in which the nailing strip is of the order of 3¼" wide embedded in a flange of the order of 4" wide, the longitudinal bend line 38 may be disposed to be spaced of the order of 1" from the innermost edge of the nailing strip 14. It is believed that locating the bend line 38 on the more inwardly disposed side of the longitudinal center line of the nailing strip and flange results in a configuration which will be useful in most typical curb-type installations. Nail holes 28 are disposed on both sides of the longitudinal line 38.

With the foregoing configuration of the nailing strip 14, to include the weakened longitudinal bend line 38, the expansion joint cover may be rolled up and shipped in its rolled, continuous configuration and in relatively long, continuous lengths, for example, fifty or one hundred foot rolls. The strip then may be unrolled at the installation site, bent manually if required, and then attached over the joint. In either case the expansion joint cover is a long, continuous length which may be spliced to the next adjacent and similarly long length of cover resulting in a minimum of splices which is very desirable. This is to be contrasted with prior curb-type installations in which it was necessary to prebend the flange at the factory which would preclude rolling of the bent covers and which required them to be shipped in a package of relatively short separate segments. As mentioned, the use of shorter, straight lengths necessarily results in a cover having numerous splices.

If desired, the outwardly facing surface of the strip 12 may be provided with a raised ridge 42 which extends along the longitudinal bend line 38 of the embedded nailing strip 14 to provide a visual indication of the location of the bend line 38 to facilitate the on-site bending operation. Also, when the flange is bent, the existence of the excess plastic material which defines the ridge 42 smoothens out to insure that the tensioned region at the outside of the bend is covered by a substantial thickness of vinyl material as suggested in FIG. 8.

It may also be noted that when the vinyl strip 12 is extruded with the nailing strips 14 embedded therein, the nailing holes 28 as well as the holes 40 which define the longitudinal bend line all fill with the vinyl material. This provides a significant interlock between the metal of the nailing strip and the vinyl of the flanges 24 which precludes longitudinal shrinkage of the vinyl in the flanges 24.

It should be understood that the foregoing description of the invention is intended merely to be illustrative thereof, and that other embodiments and modifications may be apparent to those skilled in the art without departing from its spirit.

Having thus described the invention, what we desire to claim and secure by Letters Patent is:

1. An expansion joint cover comprising:

an elongate main strip of a predetermined width;

an elongate strip of insulative material secured to and extending along one surface of the main strip, the insulative strip being of less width than the main strip thereby to define a pair of longitudinally and transversely extending flange portions of the main strip on opposite sides of the insulative strip;

each of the flange portions having an elongate nailing strip embedded therein and extending along the length thereof, and being of a width which is more than one-half that of its respective flange portion, each of the nailing strips having a plurality of nailing holes formed therein; and each of the nailing strips being formed to define a single, longitudinally extending bend line which is substantially weaker than any other portion of the nailing strip, said bend line being disposed at a predetermined location on the nailing strip, whereby when the nailing strip is bent, it will bend along said bend line, at said predetermined location.

2. An expansion joint cover as defined in claim 1 wherein each of the nailing strips is provided with nailing holes on opposite sides of the weakened bend line.

3. An expansion joint cover as defined in claim 1 further comprising:

the weakened bend line in each of the nailing strips being disposed more closely to the inner longitudinal edge of the nailing strip than to the outer edge of the nailing strip.

4. As an article of manufacture, the expansion joint cover as defined in claim 1 further comprises:

said expansion joint cover being in a rolled up configuration.

5. An expansion joint cover as defined in claim 1 comprising:

elongate main strip of a predetermined width;

an elongate strip of insulative material secured to and extending along one surface of the main strip, the insulative strip being of less width than the main strip thereby to define a pair of longitudinally and transversely extending flange portions of the main strip on opposite sides of the insulative strips;

each of the flange portions having an elongate nailing strip embedded therein and extending along the length thereof, and being of a width which is more than one-half that of its respective flange portion, each of the nailing strips having a plurality of nailing holes formed therein;

each of the nailing strips being formed to define a longitudinally extending bend line which is substantially weaker than the other portions of the nailing strip whereby when the nailing strip is bent, it will bend along said bend line;

said bend line in each of said nailing strips comprising a plurality of holes formed in the nailing strip and extending and being spaced along a longitudinally extending line, the spaces between said holes being smaller than the spaces between the nailing holes.

6. An expansion joint cover comprising:

an elongate main strip of a predetermined width;

an elongate strip of insulative material secured to and extending along one surface of the main strip, the insulative strip being of less width than the main strip thereby to define a pair of longitudinally and transversely extending flange portions of the main strip on opposite sides of the insulative strip;

each of the flange portions having an elongate nailing strip embedded therein and extending along the length thereof, and being of a width which is more than one-half that of its respective flange portion, each of the nailing strips having a plurality of nailing holes formed therein;

each of the nailing strips having a weakened bend line extending longitudinally thereof; and the main strip including an elongate ridge formed on the opposite side of the main strip on each of the flange portions thereof, each ridge being in alignment with the weakened bend line portion of the nailing strip embedded therein.

* * * * *